US007563360B2

(12) United States Patent
Yamaguchi et al.

(10) Patent No.: US 7,563,360 B2
(45) Date of Patent: Jul. 21, 2009

(54) MERCURY-REMOVAL PROCESS IN DISTILLATION TOWER

(75) Inventors: Yoshiyuki Yamaguchi, Sapporo (JP); Senichiro Kaku, Musashino (JP); Kazutoshi Chaki, Ichihara (JP)

(73) Assignee: Japan Petroleum Exploration Co., Ltd., Tokyo (JP)

( * ) Notice: Subject to any disclaimer, the term of this patent is extended or adjusted under 35 U.S.C. 154(b) by 519 days.

(21) Appl. No.: 11/043,751

(22) Filed: Jan. 26, 2005

(65) Prior Publication Data

US 2005/0167335 A1 Aug. 4, 2005

(30) Foreign Application Priority Data

Feb. 3, 2004 (JP) ..... 2004-027192

(51) Int. Cl.
*C10G 45/00* (2006.01)
*B01D 3/00* (2006.01)

(52) U.S. Cl. ..... 208/251 R; 261/151; 261/127; 261/129; 261/130; 261/131; 202/82; 202/95; 202/163; 202/168; 202/177; 202/180; 202/183; 202/185.1; 202/202; 203/39; 203/40; 203/42; 203/44; 203/46; 203/78; 203/81; 203/91; 203/94

(58) Field of Classification Search ..... 208/251 R; 261/2, 127, 129, 130, 131, 151; 202/82, 202/95, 163, 168, 176, 177, 180, 183, 185.1, 202/202; 203/39, 40, 42, 44, 46, 78, 81, 203/82, 91, 94
See application file for complete search history.

(56) References Cited

U.S. PATENT DOCUMENTS 3,852,166 A * 12/1974 Palmason ..... 208/347
4,225,394 A * 9/1980 Cox et al. ..... 203/37
4,962,276 A * 10/1990 Yan ..... 585/867
5,779,883 A * 7/1998 Hearn et al. ..... 208/213
6,409,886 B1 * 6/2002 Matsumoto et al. ..... 203/8

(Continued)

FOREIGN PATENT DOCUMENTS

JP 04-227794 8/1992

(Continued)

OTHER PUBLICATIONS

Translation of JP H04-227794 document—Publication date Aug. 17, 1992.*

*Primary Examiner*—Walter D Griffin
*Assistant Examiner*—Huy-Tram Nguyen
(74) *Attorney, Agent, or Firm*—The Webb Law Firm

(57) ABSTRACT

A top temperature $T_1$ of a distillation tower 1 is held below a liquefying temperature of a light fraction by returning a part of an exhaust gas W, which is cooled by a condenser 5, to the upper zone of the distillation tower 1. A bottom temperature $T_2$ is raised up to 300° C. at highest by returning a part of a liquid product P from a re-boiler 3 to a lower zone of the distillation tower 1. When a liquid hydrocarbon L comes in countercurrent contact with a stripping gas G inside the distillation tower 1 with the temperature profile that an inner temperature gradually falls down along an upward direction, mercury is efficiently transferred from the liquid L to a vapor phase without effusion of the light fraction in accompaniment with the exhaust gas W.

9 Claims, 2 Drawing Sheets

U.S. PATENT DOCUMENTS

| | | | | |
|---|---|---|---|---|
| 6,479,689 | B1 * | 11/2002 | Tojo et al. | 558/277 |
| 6,514,387 | B1 * | 2/2003 | Emmrich et al. | 202/153 |
| 2003/0183501 | A1 * | 10/2003 | Tamura et al. | 203/1 |
| 2004/0000470 | A1 * | 1/2004 | Gentilcore | 203/2 |

FOREIGN PATENT DOCUMENTS

| | | |
|---|---|---|
| JP | 2000-505117 | 4/2000 |

* cited by examiner

MERCURY-REMOVAL PROCESS IN DISTILLATION TOWER

TECHNICAL FIELD

The present invention relates to a process for stripping mercury from liquid hydrocarbons or the like in a distillation tower under a gas/liquid equilibrium condition.

BACKGROUND OF THE INVENTION

Mercury is conventionally removed from liquid hydrocarbons by an adsorption process, an extraction process using an aqueous liquid, a stripping process and so on. Application of the adsorption or extraction process to heavy natural gas-condensates or crude oils is difficult because of impurities. On the other hand, the stripping process efficiently removes mercury from liquid hydrocarbons, since mercury can be easily transferred from a liquid phase to a vapor phase by countercurrent contact of the liquid hydrocarbons with a stripping gas in a distillation tower. Transfer of mercury from a liquid phase to a vapor phase is promoted due to a high vapor pressure of mercury without unfavorable effects of impurities.

According to the stripping process, a mercury-containing liquid, e.g. a natural gas-condensate or crude oil, is sprayed into a distillation tower from its top, while a stripping gas, e.g. natural gas or air, is drawn from the bottom of the distillation tower. Mercury is transferred from a liquid phase to a vapor phase by countercurrent contact of the mercury-containing liquid with the stripping gas in the distillation tower.

For instance, U.S. Pat. No. 4,962,276 discloses a stripper (a distillation tower) in the form of a column packed with random packing or the like, wherein a liquid hydrocarbon or the like flows out as a liquid product from a bottom of the distillation tower after removal of mercury by countercurrent contact of the mercury-containing liquid with the stripping gas. The mercury, which is striped from the liquid hydrocarbon, is discharged together with the stripping gas, as a mercury-containing gas (hereinafter referred to as "exhaust gas", from the top of the distillation tower.

When a mercury-containing liquid comes in countercurrent contact with a stripping gas, light hydrocarbons (hereinafter referred to as "a light fraction") also transfer together with mercury to a vapor phase. Transfer of the light fraction from the mercury-containing liquid causes change of a liquid quality, so that it is necessary to install a gas/liquid separator, a fluid pump and so on in an exhaust gas line for recovery of the light fraction. Moreover, complicated and expensive post-treatment is indispensable for removal of mercury from a by-produced light fraction. Due to these disadvantages, the stripping process has not been practically applied to removal of mercury from liquid hydrocarbons.

SUMMARY OF THE INVENTION

A first object of the present invention is to develop advantages of a stripping process, which is suitable for removing mercury from a raw liquid without unfavorable effects of impurities, for production of a liquid product with less fluctuation in qualities.

A second object of the present invention is to ensure efficient removal of mercury from a liquid phase to a vapor phase by establishing a proper temperature profile in a distillation tower.

A third object of the present invention is to yield a high-quality liquid product without necessity of post-treatment for a by-produced light fraction.

The present invention proposes a new stripping process for removing mercury from various mercury-containing liquids, e.g. crude LPG, crude naphtha, crude oil and other waste liquids, which contain hardly adsorptive impurities therein. A mercury-containing liquid and a stripping gas are simultaneously fed as a downflow and an upflow, respectively, into a distillation tower, which is held in a gas/liquid equilibrium state.

An interior of the distillation tower is controlled with the temperature profile that an inner temperature gradually falls down along an upward direction from a bottom temperature $T_2$ of 300° C. at highest to a top temperature $T_1$ below a liquefying temperature of a light fraction. Mercury is vaporized and transferred to a vapor phase by countercurrent contact of the mercury-containing liquid with the stripping gas in the distillation tower.

The liquid, from which mercury is stripped, is drawn as a liquid product from a bottom of the distillation tower. Mercury vapor, which is stripped from the liquid, is discharged together with the stripping gas as an exhaust gas from a top of the distillation tower. The exhaust gas may be recycled as a part of the stripping gas after passing through an active adsorbent for removal of mercury.

The top temperature $T_1$ is held at a value below a liquefying temperature of a light fraction by self-cooling in the distillation tower with an overhead condenser or by returning a part of the exhaust gas, which is discharged from the top of the distillation tower and then artificially cooled, to an upper zone of the distillation tower with a partial condenser. The bottom temperature $T_2$ is raised up to 300° C. at highest by controlling a pre-heating temperature of the mercury-containing liquid below 300° C. or by returning a part of the liquid product, which is drawn from the bottom of the distillation tower and then re-boiled, to a lower zone of the distillation tower. The exhaust gas line from the top of the distillation tower to a mercury adsorption tower is kept warm more than the liquefying temperature of the light fraction without regenerating a mercury-containing light fraction in the exhaust gas line.

Mercury is an element with a high vapor pressure, and the vapor pressure becomes higher in correspondence with temperature rising and pressure dropping. Characteristics of mercury vaporization are the same as that of short-chained hydrocarbons such as pentane and hexane. The characteristics of mercury vaporization indicates possibility of mercury removal without substantial transfer of a light fraction to a vapor phase in the case where an interior of a distillation tower is held at a lower temperature. However, the lower inner temperature causes prolongation of gas/liquid contact inappropriate for efficient and economical mercury removal. The prolongation of gas/liquid contact can be avoided by the temperature profile that an inner temperature of the distillation tower, which is held in a gas/liquid equilibrium state, is lower at its top but higher at its bottom in relation with an evaporating temperature of the light fraction.

Efficiency of mercury removal is enhanced by holding a bottom temperature $T_2$ at the highest possible level. Generation of a light fraction in an exhaust gas line and then in an adsorption tower is suppressed by holding a top temperature $T_1$ at the lowest possible level. The efficiency of mercury removal is somewhat reduced by lowering the top temperature $T_1$, as compared with conventional conditions for operating a distillation tower at a higher temperature as a whole. A decrease in the efficiency of mercury removal is suppressed by increasing number of trays inside the distillation tower or by raising a gas/liquid ratio.

Although temperature condition is varied in correspondence with an internal pressure of the distillation tower, the bottom temperature $T_2$ shall be 300° C. at highest for efficient transfer of mercury from a liquid phase to a vapor phase without pyrolysis of a mercury-containing liquid, and the top temperature $T_1$ shall be lower than a liquefying temperature of a light fraction. As far as the bottom temperature $T_2$ and the top temperature $T_1$ are lower than 300° C. and the liquefying temperature of a light fraction, respectively, the temperatures $T_2$ and $T_1$ are predetermined at proper values in relation with a kind of the mercury-containing liquid and the internal pressure. For instance, the top temperature $T_1$ is held at a value below 93° C. for recovery of naphtha or at a value below 65° C. for treatment of waste water.

BEST MODES OF THE INVENTION

Figure 1:
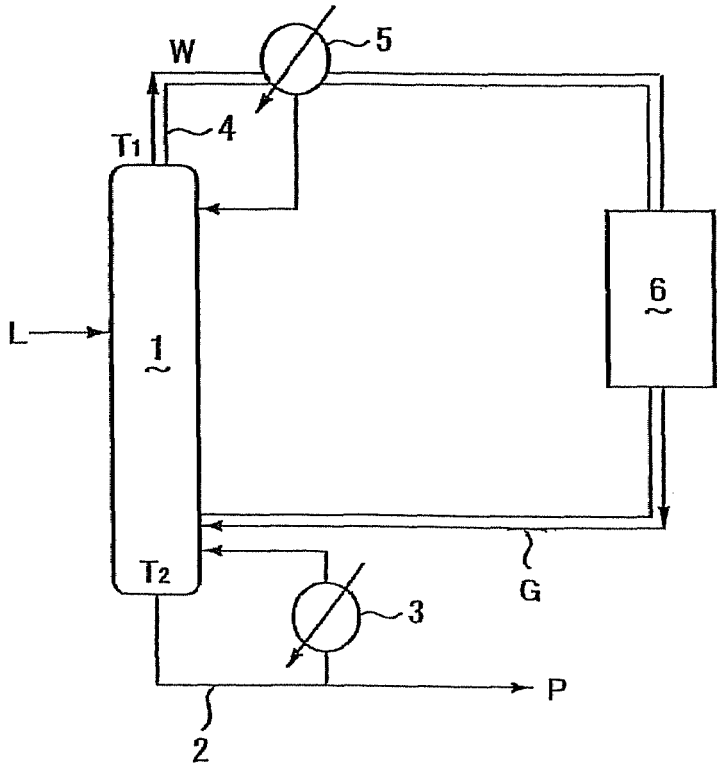
FIG. 1 is a schematic view, which illustrates a plant for stripping mercury from liquid hydrocarbons according to a stripping process.
Figure 2:
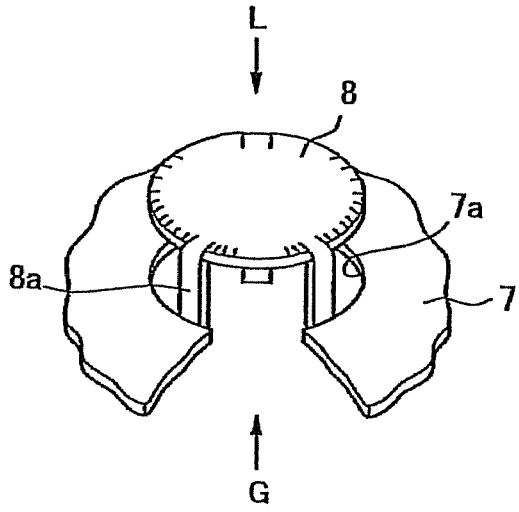
FIG. 2 is a view for explanation of a bubble tray.

The present invention uses a plant, which is schematically illustrated in FIG. 1, for processing a mercury-containing liquid, e.g. crude oil, a heavy natural gas-condensate, crude LPG, crude naphtha or waste liquids, which contains hardly absorptive impurities therein.

A distillation tower 1 is in the form of a column packed with random packing, e.g. Raschig rings, Cascade mini-rings or the like for promotion of gas/liquid contact between a stripping gas G and a mercury-containing liquid L. A top temperature $T_1$ and a bottom temperature $T_2$ of the distillation tower 1 are controlled to values below 93° C. (preferably 50-65° C.) and below 300° C. (preferably 120-150° C.), respectively, for recovery of naphtha. The liquid L is fed as a downflow into a top of the distillation tower 1, while the stripping gas G is fed as an upflow into a bottom of the distillation tower 1. The liquid L comes in countercurrent contact with the stripping gas G inside the distillation tower 1.

A processed liquid L, from which mercury is stripped by the countercurrent contact, flows out as a liquid product P through a product oil line 2 from the bottom of the distillation tower 1. A part of the liquid product P is re-boiled by a re-boiler 3, which is provided at the product oil line 2, and then returned to the lower zone of the distillation tower 1, so as to raise the bottom temperature $T_2$ up to 300° C. at highest. The raw liquid L may be pre-heated at a proper temperature to raise the bottom temperature $T_2$.

The stripping gas G, to which mercury is transferred from the liquid L, is discharged as an exhaust gas W from the top of the distillation tower 1 and sent through an exhaust gas line 4 to a condenser 5 and then to an adsorption tower 6 The exhaust gas line 4 is preferably equipped with a heat trace, in order to warm the exhaust gas W, which is passing through the exhaust gas line 4, at a temperature higher than a liquefying temperature of a light fraction for prevention of the light fraction from re-condensation.

A part of the exhaust gas W is cooled by the condenser 5 and then returned to the upper zone of the distillation tower 1, so as to hold the top temperature $T_1$ below the liquefying temperature of the light fraction, e.g. below 93° C. for recovery of naphtha.

The adsorption tower 6 is packed with adsorbents for removal of mercury from the exhaust gas W. After removal of mercury, the clean exhaust gas W is recycled as a part of the stripping gas G to the distillation tower 1. A volume of the recycle gas G is controlled at a value suitable for stripping treatment by timely replenishment with fresh gas.

The raw liquid L is a liquid hydrocarbon, crude oil, a heavy natural gas-condensate, crude LPG, crude naphtha, waste liquids or the like. The stripping gas G is a lower hydrocarbon, e.g. methane, ethane, propane or natural gas, or inert gas, e.g. carbon dioxide, nitrogen, argon or helium. Air is also useful as the stripping gas G for processing waste water as the liquid L, wherein steam is regarded as a light fraction.

Gas/liquid contact is representatively performed by a bubble tray type distillation tower in a gas/liquid equilibrium state. In the bubble tray type distillation tower, a plurality of trays 7, which have many holes 7*a*, are disposed along a vertical direction of the distillation tower 1. Each hole 7*a* has a cap 8 capable of vertical motion in correspondence with a differential pressure between a raw liquid L (a downflow) and a stripping gas G (an upflow). The cap 8 has legs 8*a* inserted in the hole 7*a*. An upward force is applied to the cap 8 by the stripping gas G, while a downward force is applied to the cap 8 by the raw liquid L. As a result, the cap 8 is held at a height level where a pressure of the raw liquid L is balanced with a pressure of the stripping gas G, so as to accelerate countercurrent contact of the raw liquid L with the stripping gas G for mercury removal. Other types, e.g. a bubble-cap tray or a sieve tray, may be also employed instead of the bubble tray.

In the case where a raw liquid L with low mercury concentration is processed, there are no restrictions on a ratio (gas/liquid ratio) of a stripping gas G to the raw liquid L, which are fed into the distillation tower 1. In the case where a raw liquid L with high mercury concentration, e.g. 0.01 ppm or more, is processed, a gas/liquid ratio is preferably predetermined at 10 $m^3$/kl or more. In the case where low-boiling crude naphtha is processed, an internal pressure is preferably raised to suppress evaporation of a light fraction.

An inner temperature of the distillation tower 1 gradually falls down along an upward direction from the bottom temperature $T_2$ to the top temperature $T_1$. Due to the temperature profile, transfer of-mercury from a liquid phase to a vapor phase is accelerated at the lower zone of the distillation tower 1, and the light fraction such as naphtha is recovered from the vapor phase to the liquid phase at the upper zone of the distillation tower 1 although vaporization of mercury is somewhat retarded.

When the distillation tower 1 is operated at an internal pressure near the atmospheric pressure (approximately 0.1 MPa), mercury behaves as the same as short-chained hydrocarbons such as pentane and hexane. Transfer of mercury from a liquid phase to a vapor phase is more accelerated without vaporization of a light fraction, as an inner temperature of the distillation tower 1 is lower. In this sense, it is most profitable to hold the top temperature $T_1$ within a range of 50-65° C. The bottom temperature $T_2$ is determined at a proper value in relation with characteristics of a raw liquid L.

For instance, a temperature within a range of 120-150° C. is the most effective bottom temperature $T_2$ for processing heavy natural gas-condensates. Low-boiling light gas-condensates are preferably processed under an internal pressure of 2 MPa or less, in order to preferentially vaporize mercury without substantial transfer of a light fraction to a vapor phase.

In the case where waste liquids are processed for mercury removal, it is preferable to control an internal pressure at 0.5 KPa or less, a top temperature $T_1$ within a range of 40-65° C. and a bottom temperature $T_2$ within a range of 60-100° C.

Due to control of the temperature profile inside the distillation tower 1, mercury is preferentially and efficiently stripped from liquid hydrocarbons, which originally contains 0.01-several ppm of mercury, at a rate of 90% or higher. Transfer of a light fraction to a vapor phase is also suppressed, so that qualities, e.g. a vapor pressure and pour point, of a liquid product P are stabilized with less deviation. A part of mercury, which still remains in the raw liquid L without vaporization, can be effectively transferred to the vapor phase by an increase of number of trays in the distillation tower 1 and number of the distillation towers 1 or by raising a gas/liquid ratio.

For comparison, under the condition that a raw liquid L comes in countercurrent contact with a stripping gas G in a distillation tower 1, which is uniformly held at a relatively higher temperature of 150° C., mercury violently transfers from a liquid phase to a vapor phase, and a liquid product P with low mercury concentration flows out from a bottom of the distillation tower 1. But, a light fraction also significantly transfers to the vapor phase due to the higher inner temperature, so that it is unavoidable to separate and recover the light fraction from an exhaust gas W in the succeeding step. Moreover, the bottom of the distillation tower 1 is partially cooled down due to heat consumption for evaporation of the light fraction, resulting in retard of mercury vaporization at the lower zone of the distillation tower 1.

Transfer of a light fraction to an exhaust gas W could be inhibited by lowering an inner temperature of a distillation tower 1 uniformly below 50° C. However, such a lower temperature leads to a significant decrease in mercury removal efficiency, unless trays of the distillation tower 1 are too increased in number or a raw liquid L is held in contact with a stripping gas G for a fairly long while.

Figure 3:
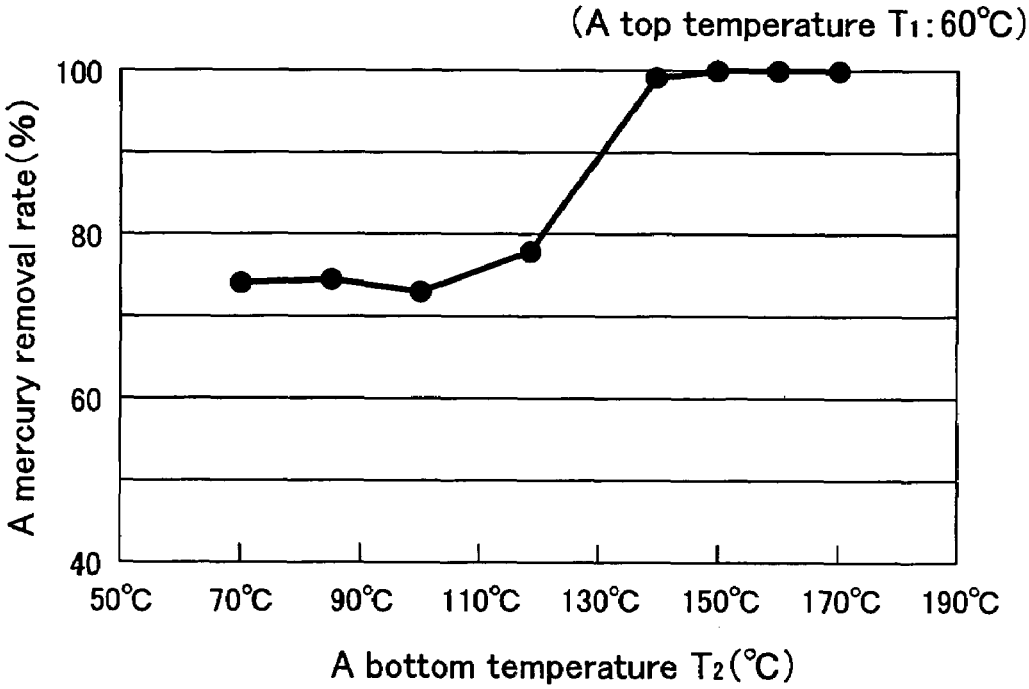
FIG. 3 is a graph, which represents effects of a temperature profile on mercury concentrations of a liquid product.

On the other hand, mercury concentration of a liquid product P is more reduced as elevation of a bottom temperature $T_2$ with the provision that a top temperature $T_1$ is held at 60° C. below a liquefying temperature of a light fraction. A liquid product, which is yielded at a bottom temperature $T_2$ of 130° C. or higher, does not substantially contain mercury, as noted in FIG. 3, which shows operation results under the condition that the distillation tower 1 is operated with a gas/liquid ratio of 85 $m^3$/kl at an internal pressure of 0.14 MPa. Moreover, effusion of the light fraction is inhibited by lowering the top temperature $T_1$; otherwise the light fraction would be effused together with an exhaust gas W from the distillation tower 1.

EXAMPLE

A mercury-containing heavy natural gas-condensate was processed in a bubble-cap tray type distillation tower 1 of 13 m in height provided with a gas-injection nozzle at its lower part. The condensate L was fed as a downflow at a flow rate of 10 kl/hour into the distillation tower 1, while a natural gas G was fed as an upflow with a gas/liquid ratio of 80 $m^3$/kl through the gas-injection nozzle into the distillation tower 1. The condensate L came in countercurrent contact with the stripping gas G in the distillation tower 1.

A top temperature $T_1$ and a bottom temperature $T_2$ of the distillation tower were variously varied under the above conditions, to investigate effects of the temperatures $T_1$ and $T_2$ on behaviors of mercury and a light fraction. Mercury concentration of a liquid product P was measured by Atomic Adsorption Spectroscopy (Gold-Amalgamation Method).

[Conventional Process]

The distillation tower 1 was uniformly held at 120° C. without giving temperature gradient. A heavy natural gas-condensate L was pre-heated at 120° C., fed into the distillation tower 1 and brought into countercurrent contact with a natural gas (a stripping gas) G. During processing, a top temperature $T_1$ was kept at 121° C., but a bottom temperature $T_2$ fell down to 113° C. due to a latent heat of vaporization. A liquid product P, which flew out from the bottom of the distillation tower 1, had mercury concentration of 0.007 ppm (i.e., a mercury-removal rate of 96.5%). However, a light fraction was included in an exhaust gas W at a ratio of 13% based on the law liquid L.

[Inventive Process 1]

A top temperature $T_1$ was controlled to 60° C., and a bottom temperature $T_2$ was controlled to 150° C. by warming the bottom zone of the distillation tower 1 with a liquid returned from a re-boiler 3. That is, the distillation tower 1 was held with the temperature profile that an inner temperature gradually fell down along an upward direction. A heavy natural gas-condensate with relatively higher mercury concentration of 1.3 ppm was processed as a raw liquid L by countercurrent contact with a natural gas G inside the distillation tower 1. A liquid product P had mercury concentration of 0.11 ppm (i.e., a mercury-removal rate of 91.5%), and a light fraction in an exhaust gas W was less than a detection limit.

[Inventive Process 2]

A heavy natural gas-condensate with normal mercury concentration of 0.2 ppm was fed as a raw liquid L into the distillation tower 1 with the temperature profile that a top temperature $T_1$ and a bottom temperature $T_2$ were held at 60° C. and 135° C., respectively, and processed by countercurrent contact with a natural gas G inside the distillation tower 1. An exhaust gas line 4 was warmed at 60° C. or higher in order to inhibit re-condensation of a light fraction from the exhaust gas G, which flew through the exhaust gas line 4. A liquid product P had mercury concentration of 0.009 ppm (i.e., a mercury-removal rate of 95.5%), and a light fraction in an exhaust gas W was less than a detection limit.

It is noted from results in Table 1 that efficient mercury removal with less transfer of the light fraction to the exhaust gas G was performed by proper control of the top temperature $T_1$ and the bottom temperature $T_2$. Moreover, the liquid product P had stable qualities with less deviations, since evaporation and transfer of the light fraction to a vapor phase was suppressed.

On the contrary, an exhaust gas W, which was by-produced in the conventional example, was necessarily post-treated for recovery of a light fraction, using a gas/liquid separator and a fluid pump, since the light fraction was significantly effused from the raw liquid L to the exhaust gas W.

TABLE 1

Effects of Top Temperature $T_1$ and Bottom Temperature $T_2$ on Mercury Concentration of Liquid Product and Inclusion of Light Fraction in Exhaust Gas

| | Conventional Process | Inventive Process 1 | Inventive Process 2 |
|---|---|---|---|
| Operational Conditions | | | |
| mercury concentration (ppm) before processing | 0.2 | 1.3 | 0.2 |
| a top temperature $T_1$ (° C.) | 121 | 60 | 60 |
| a bottom temperature $T_2$ (° C.) | 113 | 150 | 135 |
| an internal pressure (MPa) | 0.15 | 0.20 | 0.15 |
| a gas/liquid ratio ($m^3$/kl) | 80 | 80 | 80 |
| Results | | | |
| mercury concentration (ppm) of a liquid product | 0.007 | 0.110 | 0.009 |
| a mercury removal rate (%) | 96.5 | 91.5 | 95.5 |

TABLE 1-continued

Effects of Top Temperature $T_1$ and Bottom Temperature $T_2$ on Mercury Concentration of Liquid Product and Inclusion of Light Fraction in Exhaust Gas

| | Conventional Process | Inventive Process 1 | Inventive Process 2 |
|---|---|---|---|
| a rate (%) of a light fraction in an exhaust gas | 13 | undetected | undetected |

A heavy natural gas-condensate was fed as a raw liquid to the distillation tower.

The rate of a light fraction is calculated as a volume ratio based on the raw liquid (heavy natural gas-condensate).

According to the present invention as above-mentioned, a liquid product P, which is substantially free from mercury, is yielded by processing a raw liquid in a distillation tower with the temperature profile that an inner temperature gradually falls down along an upward direction from a bottom temperature $T_2$ of 300° C. at highest to a top temperature $T_1$ below a liquefying temperature of a light fraction. Effusion of a light fraction in accompaniment with an exhaust gas W is also suppressed due to the lower top temperature $T_1$, so that it is not necessary to provide a gas/liquid separator or a fluid pump at an exhaust gas line for recovery of the light fraction from the exhaust gas W.

The liquid product P has stable qualities with less deviations, since the light fraction mostly remains in the liquid product P. Consequently, advantages of a stripping process are profitably achieved for construction of a mercury-removal system for mercury-containing heavy hydrocarbon condensates.

The invention claimed is:

1. A mercury-removal process, comprising:

holding a distillation tower in a gas/liquid equilibrium state where an inner temperature gradually decreases along an upward direction, from a bottom temperature $T_2$ of 300° C. at most to a top temperature $T_1$ which is below the liquefying temperature of a light fraction;

feeding a mercury-containing liquid as a downflow and a stripping gas as an upflow into the distillation tower, whereby mercury is transferred from the mercury-containing liquid to the stripping gas by countercurrent contact inside the distillation tower;

discharging the stripping gas with the transferred mercury as an exhaust gas from a top of the distillation tower through an exhaust gas line to an adsorption tower; and recovering the liquid from which mercury is stripped as a liquid product from a bottom of the distillation tower, wherein a part of the exhaust gas is cooled and returned to an upper zone of the distillation tower so as to keep the top temperature T1 below the liquefying temperature of the light fraction.

2. The mercury-removal process of claim 1, wherein the exhaust gas is returned as a part of the stripping gas to a lower zone of the distillation tower after removal of mercury.

3. The mercury-removal process of claim 1, wherein the liquid product is partially re-boiled and returned to a lower zone of the distillation tower so as to raise and keep the bottom temperature $T_2$ up to 300° C. at highest.

4. The mercury-removal process of claim 1, wherein the exhaust gas line is kept warm at a temperature higher than the liquefying temperature of the light fraction.

5. The mercury-removal process of claim 1, wherein the mercury-containing liquid is a liquid hydrocarbon, and the top temperature $T_1$ is held at a value below 93° C.

6. The mercury-removal process of claim 1, wherein the bottom temperature $T_2$ is within a range from 120 to 150° C.

7. A mercury-removal process, comprising:

holding a distillation tower in a gas/liquid equilibrium state where an inner temperature gradually decreases along an upward direction, from a bottom temperature $T_2$ of at most 300° C. to a top temperature $T_1$ which is below the liquefying temperature of a light fraction;

feeding a mercury-containing liquid as a downflow and a stripping gas as an upflow into the distillation tower, whereby mercury is transferred from the mercury-containing liquid to the stripping gas by countercurrent contact inside the distillation tower;

discharging the stripping gas with the transferred mercury as an exhaust gas from the top of the distillation tower through an exhaust gas line to an adsorption tower; and recovering the liquid from which, mercury is stripped as a liquid product from a bottom of the distillation tower, wherein the liquid product is partially re-boiled and returned to a lower zone of the distillation tower so as to raise and keep the bottom temperature $T_2$ up to at most 300° C.

8. The mercury-removal process of claim 7, wherein the mercury-containing liquid is a liquid hydrocarbon, and the top temperature $T_1$ is held at a value below 93° C.

9. The mercury-removal process of claim 7, wherein the bottom temperature $T_2$ is within a range from 120 to 150° C.

* * * * *